US006834499B2

(12) United States Patent
Lin

(10) Patent No.: US 6,834,499 B2
(45) Date of Patent: Dec. 28, 2004

(54) FLOW WAY STRUCTURE OF PNEUMATIC TOOL

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 149 days.

(21) Appl. No.: 10/359,649

(22) Filed: Feb. 7, 2003

(65) Prior Publication Data

US 2004/0154293 A1 Aug. 12, 2004

(51) Int. Cl.[7] ..... F16D 31/02
(52) U.S. Cl. ..... 60/407; 60/456; 451/450
(58) Field of Search ..... 60/407, 411, 456; 418/270, 15; 451/7, 53, 449, 450

(56) References Cited

U.S. PATENT DOCUMENTS 4,102,084 A * 7/1978 Bloomquist ..... 451/450
4,187,063 A * 2/1980 Yoshida et al. ..... 418/90
5,411,386 A * 5/1995 Huber et al. ..... 60/325
5,445,558 A * 8/1995 Hutchins ..... 451/450

* cited by examiner

*Primary Examiner*—Edward K. Look
*Assistant Examiner*—Igor Kershteyn
(74) *Attorney, Agent, or Firm*—Troxell Law Office PLLC

(57) ABSTRACT

Flow way structure of pneumatic tool, including: a main body; a connector rotatably disposed on the main body; an air inlet, a water inlet and at least one air outlet concentrically arranged on the connector, inner end of each air outlet communicating with an air chamber of the main body; an air inlet switch and a water inlet switch mounted in the main body for controlling the flow of the fluid; an air way for conducting the air into the main body and communicating with a pneumatic cylinder disposed in the main body; and a water way for conducting the water into the main body. Two ends of the air way and water way are concentrically respectively connected with the air inlet and water inlet. When the connector rotates on the main body, the air inlet and the water inlet respectively still keep communicating with the air way and water way. In use, the air and water are respectively conducted from the air way and water way into the main body. The air drives the cylinder and then is exhausted through the air chamber from the air outlet. The water is drained out from water outlet tubes connected with the main body.

16 Claims, 14 Drawing Sheets

FLOW WAY STRUCTURE OF PNEUMATIC TOOL

BACKGROUND OF THE INVENTION

The present invention is related to a pneumatic tool, and more particularly to a fluid flow way structure of pneumatic tool. The air inlet, air outlet and water inlet are disposed in the same position. In use, the air inlet-tube and the water inlet tube will not tangle with each other.

There are various types of pneumatic tools such as pneumatic grinder. High pressure air is the power source of the pneumatic tools. The high pressure air is conducted through a pipeline into the pneumatic tool and then exhausted therefrom for operating the pneumatic tool. The air inlet and air outlet of the conventional pneumatic grinder are positioned in different positions. For example, the air outlet is disposed on bottom face or lateral face of the grinder. Under such circumstance, the waste gas is exhausted from the air outlet to directly blow to the environment of the working site. The powdered dust produced in the grinding operation is entrained by the exhausted waste gas to scatter around the entire working site. This seriously affects industrial sanitation and health of workers.

In addition, in order to minify scattering powder in grinding operation, the pneumatic grinder is often connected with a water source via a pipeline. The water is sprinkled onto the grinding position to wet the powder. However, when moving the grinder, the air inlet tube and the water inlet tube often tangle with each other to affect the grinding operation.

SUMMARY OF THE INVENTION

It is therefore a primary object of the present invention to provide a flow way structure of pneumatic tool, in which the air inlet and air outlets are coaxially arranged, whereby the waste gas will not be exhausted to fly in the working site.

It is a further object of the present invention to provide the above flow way structure of pneumatic tool with water sprinkling effect. The air inlet, air outlets and water inlet are coaxially arranged, whereby the air inlet tube and the water inlet tube will not tangle with each other.

The present invention can be best understood through the following description and accompanying drawings wherein:

DETAILED DESCRIPTION OF THE PREFERRED EMBODIMENT

Figure 1:
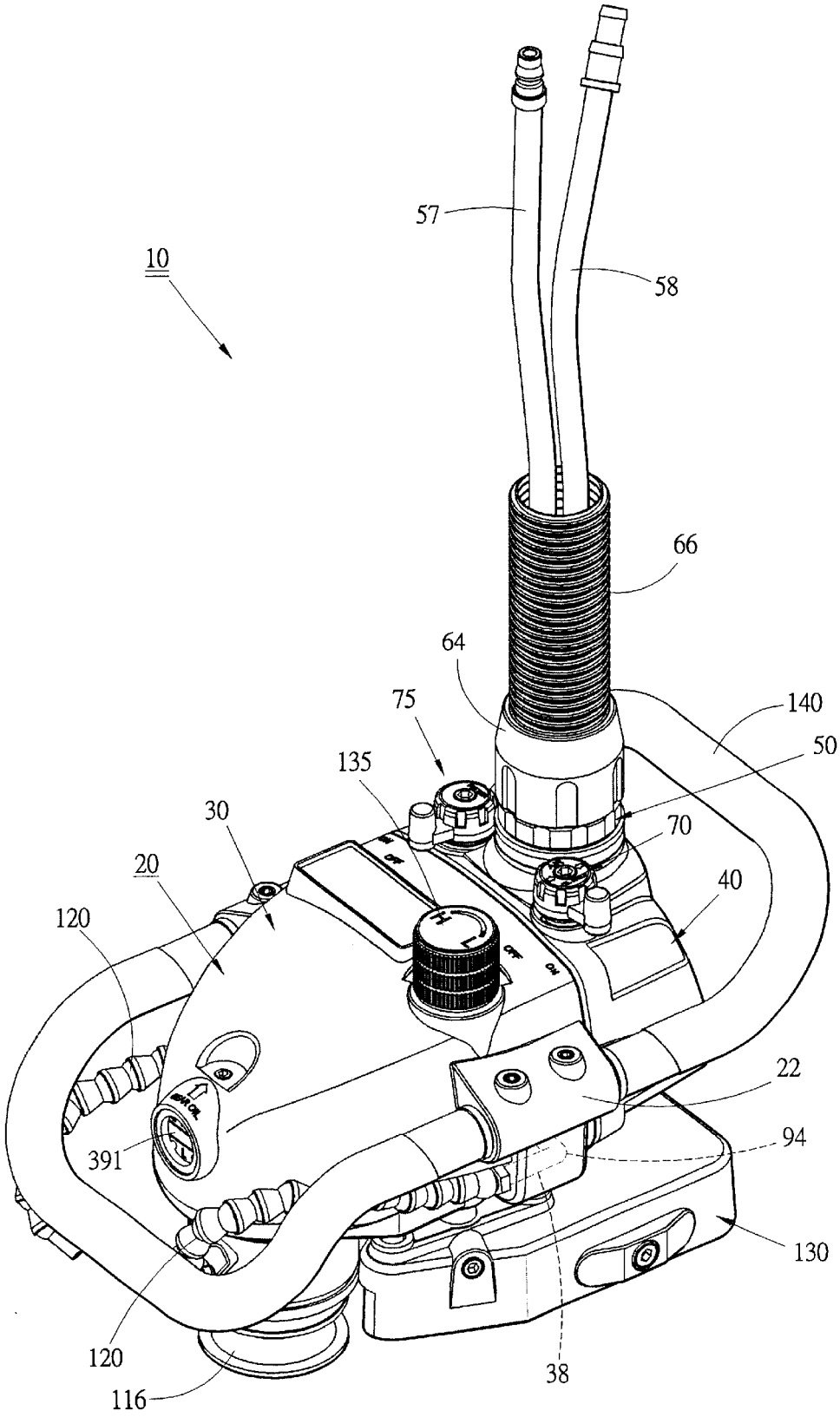
FIG. 1 is a perspective assembled view of a preferred embodiment of the present invention.

Please refer to FIG. 1. In a preferred embodiment of the present invention, the pneumatic tool 10 is a pneumatic grinder capable of wetting powdered dust. The pneumatic grinder is connected with an air inlet tube 57 and a water inlet tube 58. The pneumatic grinder 10 includes a main body 20 composed of a front casing 30 and a rear casing 40. An air inlet switch 70 and a water inlet switch 75 are disposed on the rear casing 40 for controlling the flow of the fluid. A pneumatic cylinder and a transmission mechanism are mounted in the front casing 30.

Figure 2:
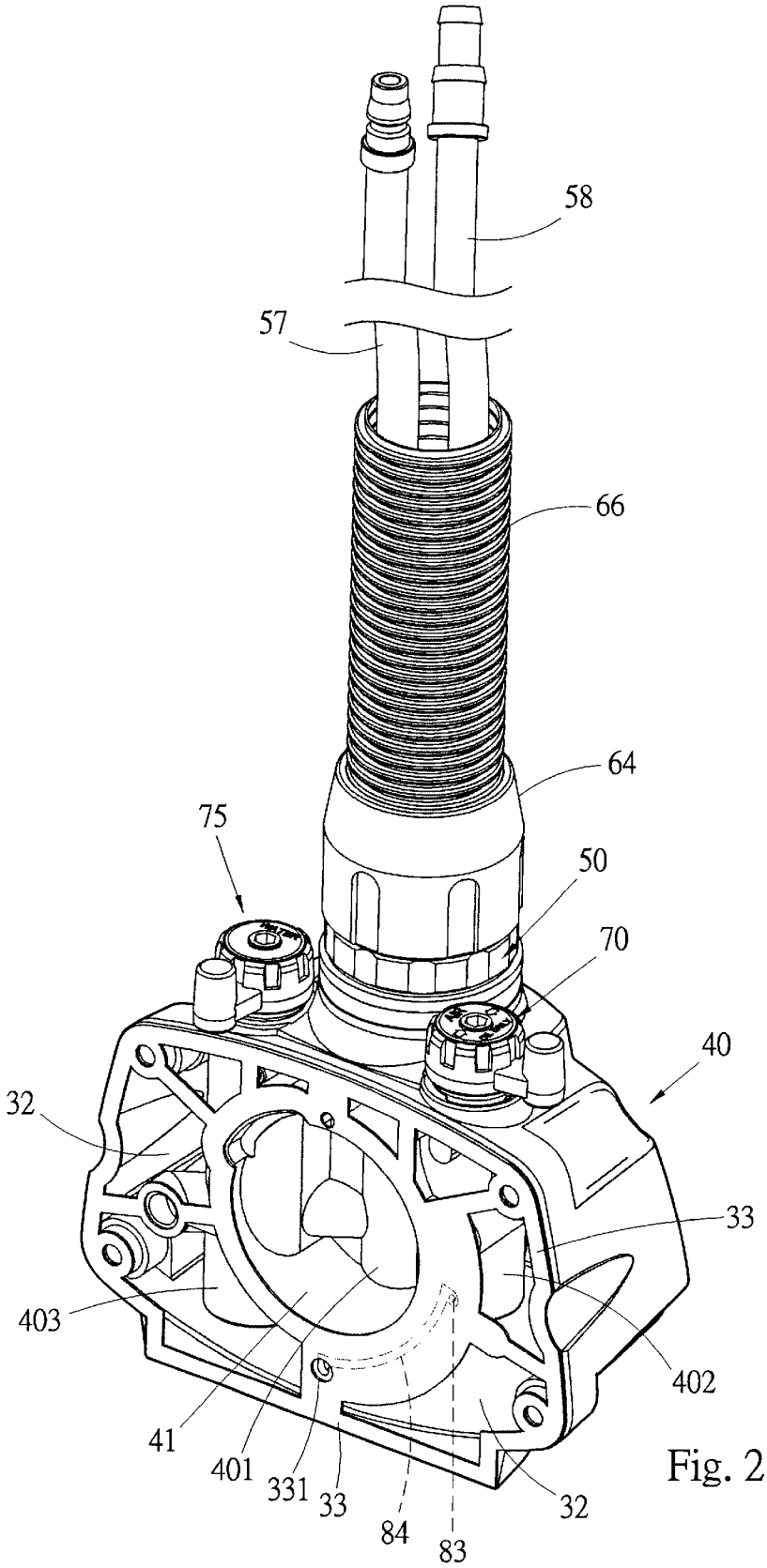
FIG. 2 is a perspective view of the rear casing of FIG. 1.

Referring to FIG. 2, the rear casing 40 has a hollow interior section forming a part of an air chamber 32 (which will be described in detail hereafter). Several solid bodies 401, 402, 403 are arranged in the hollow section. The center of front end of the rear casing is formed with an independent cavity 41 which is not communicated with the air chamber 32.

Figure 4:
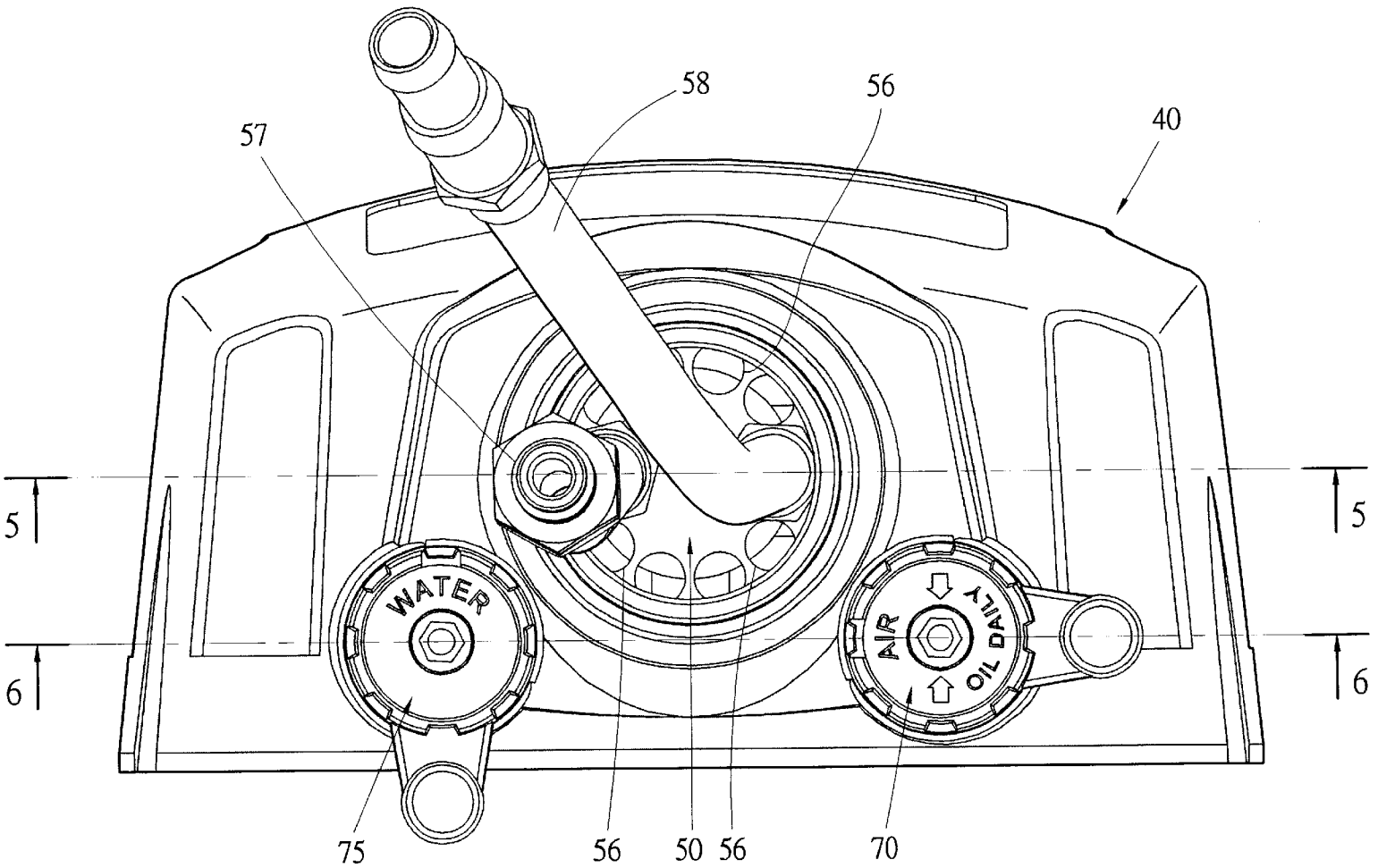
FIG. 4 is a top view according to FIG. 2.
Figure 5:
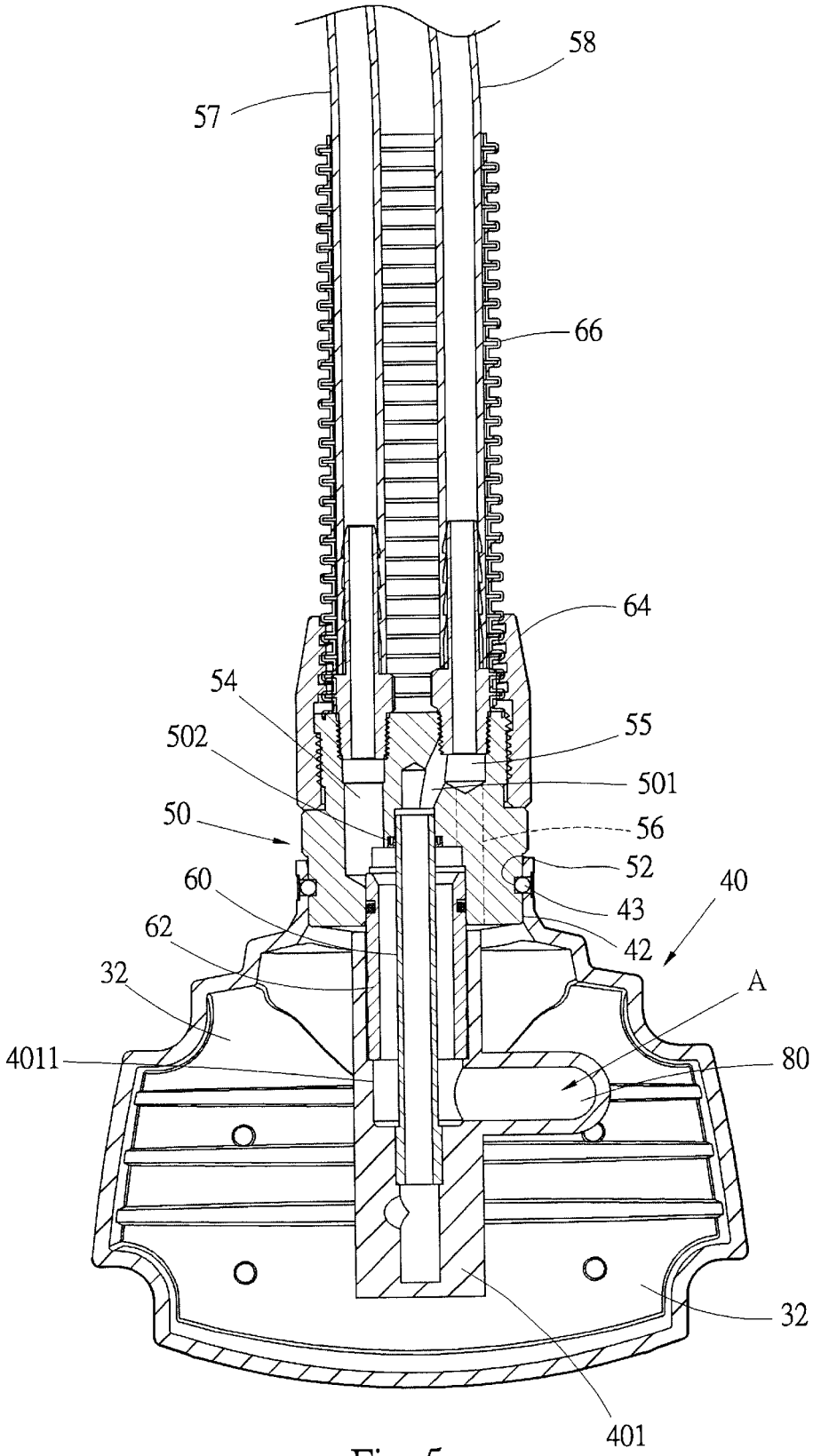
FIG. 5 is a sectional view taken along line 5—5 of FIG. 4.

A connector 50 is rotatably disposed in a through hole 42 of top face of the rear casing 40 as shown in FIGS. 2 and 5. The circumference of bottom end of the connector is formed with an annular groove 52. Several balls 43 are embedded in the circumference of the through hole 42 and engaged in the annular groove 52 so that the connector is easy to rotate without detachment. As shown in FIGS. 4 and 5, an air inlet 54, a water inlet 55 and a predetermined number of air outlets 56 are arranged on the connector 50 in a circumference concentric with the connector. The bottom ends of the air outlets 56 pass through the bottom face of the connector to communicate with the air chamber 32 as shown by phantom line of FIG. 5 and FIG. 14.

Said air inlet tube 57 is mounted in the air inlet 54, while said water inlet tube 58 is mounted in the water inlet 55.

A first inner tube 60 and a first outer tube 62 are concentrically disposed in a stepped hole 4011 of the solid body 401 of the rear casing 40. The bottom end of the air inlet 54 communicates with top end of the outer tube 62. The water inlet 55 via an oblique hole 501 formed in the connector 50 communicates with the inner tube 60. A leakproof ring 502 is disposed between the inner side of the connector 50 and the top end of the inner tube 60 to keep the flow ways of the inner and outer tubes 60, 62 independent of each other, whereby the fluids will not mix with each other. The inner and outer tubes and the connector 50 are concentric so that when the connector rotates on the rear casing, the air inlet 54 always communicates with the outer tube and the water inlet 55 always communicates with the inner tube. The outer tube 62 is a part of an air passage A which will be described hereafter, while the inner tube 60 is a part of a water passage B which will be described hereafter.

In addition, a sleeve 64 is fixed around the connector 50. A soft tube 66 is fitted in the sleeve for enclosing the air inlet tub and water inlet tube.

Figure 6:
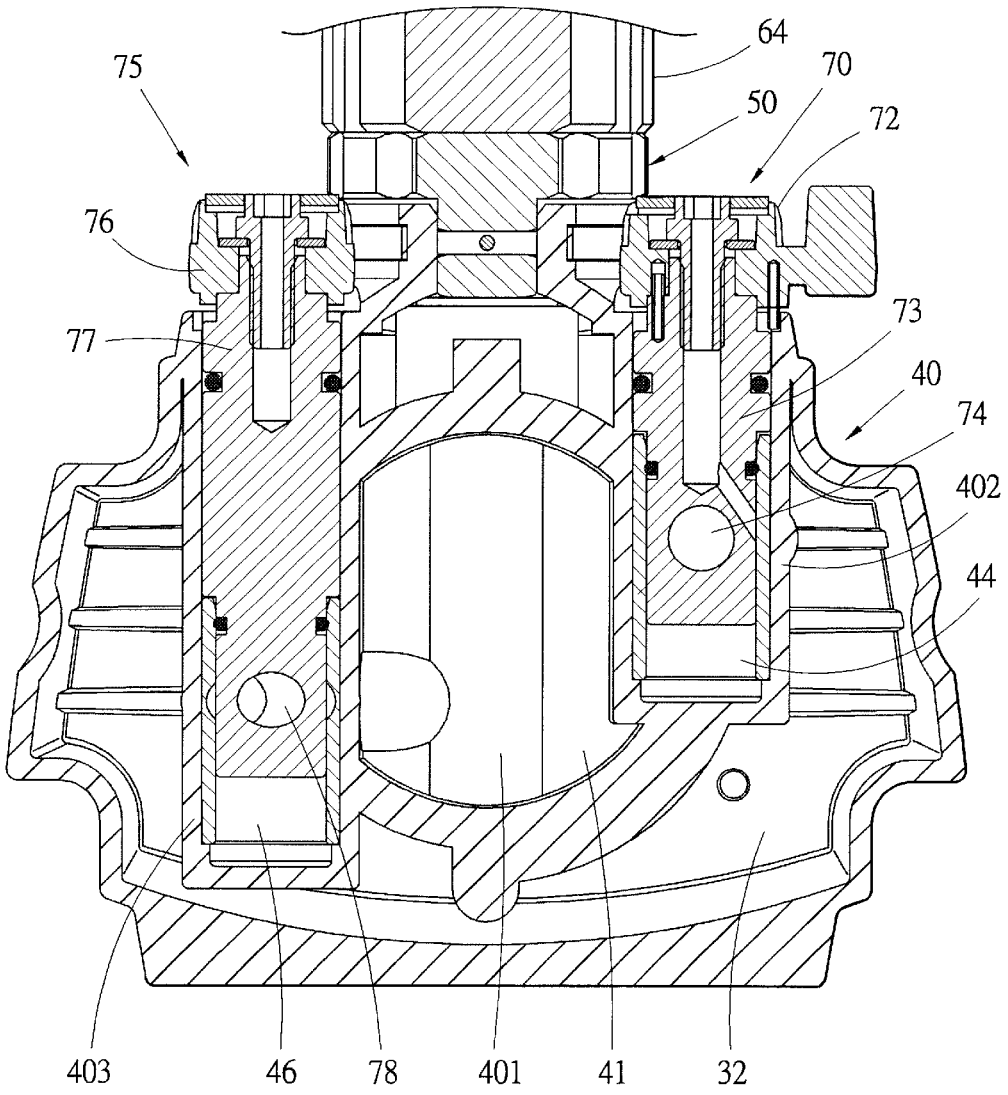
FIG. 6 is a sectional view taken along line 6—6 of FIG. 4.

Referring to FIG. 6, the air inlet switch 70 has a rotary switch 72 and a valve 73 connected with each other. The valve 73 is mounted in the cavity 44 of the solid body 402 of the rear casing 40. The rotary switch 72 is exposed to outer side for operation. A tunnel 74 transversely passes through the valve 73.

The water inlet switch 75 has a rotary switch 76 and a valve 77 connected with each other. The valve 77 is mounted in the cavity 46 of the solid body 403 of the rear casing 40. The rotary switch 76 is exposed to outer side for operation. The valve 77 is formed with a tunnel 78.

Figure 3:
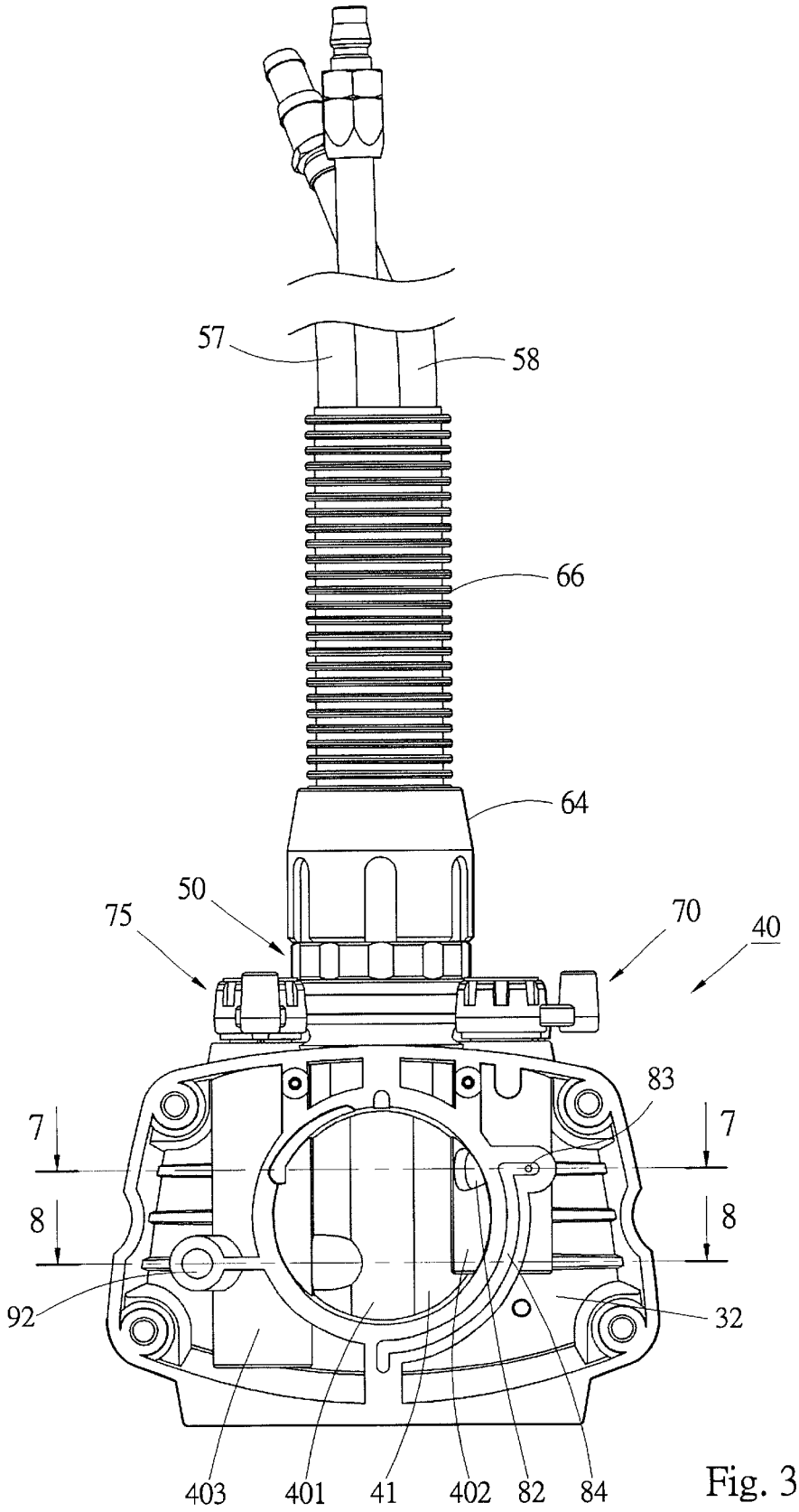
FIG. 3 is a front view according to FIG. 2 with the washer removed.
Figure 7:
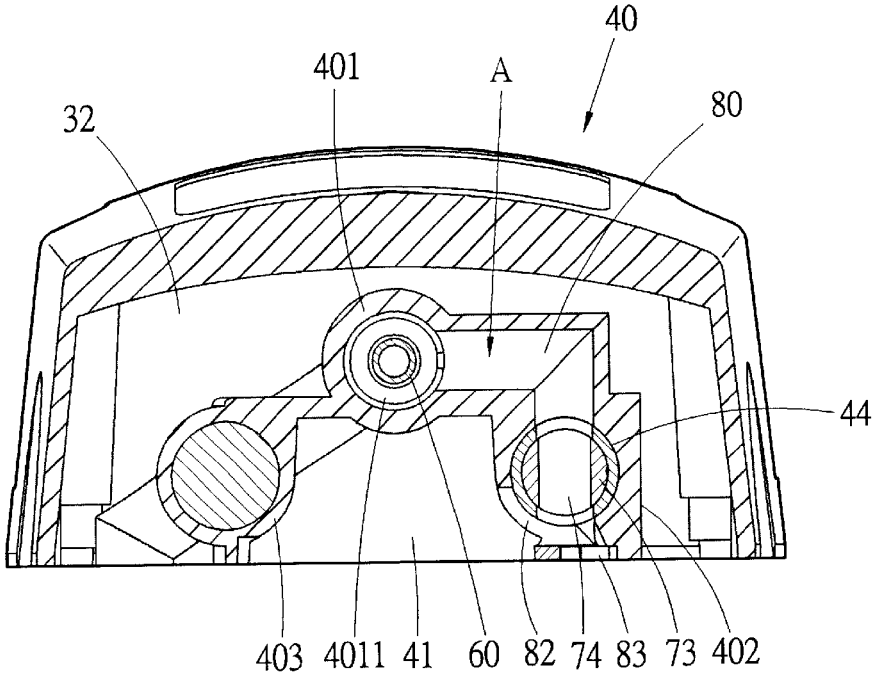
FIG. 7 is a sectional view taken along line 7—7 of FIG. 3.

The air passage A includes a part positioned in the rear casing and a part positioned in the front casing. Referring to FIGS. 5 and 7, in addition to the outer tube 62, the part in the rear casing further includes a flow way 80 communicating one side of the solid body 401 and rear edge of the solid body 402 for communicating the outer tube 62 and the cavity 44 in which the air inlet switch is mounted. In addition, the air passage A further has a main hole 82 and a subsidiary hole 83 formed on front side of the solid body 402 and spaced from each other to serve as bypasses both communicating with the cavity 44. The main hole 82 is biased to one side to communicate with the cavity 41 of the rear casing 40. The subsidiary hole 83 passes through the front face of the rear casing to connect with top end of an arched passage 84 as shown in FIG. 3. It should be noted that when the rear casing 40 is assembled with the front casing 30, a washer 33 is airtight laid between the front and rear casings. The washer 33 covers the subsidiary hole 83 and the arched passage 84 and only a small hole 331 remains aimed at the bottom end of the arched passage 84. Therefore, the fluid flowing out from the subsidiary hole will flow out from the small hole 331.

Figure 8:
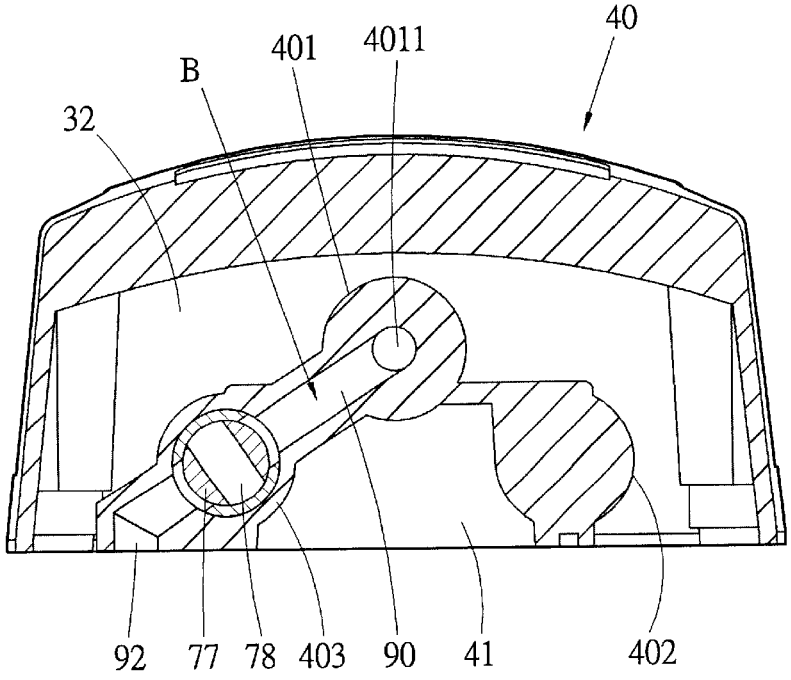
FIG. 8 is a sectional view taken along line 8—8 of FIG. 3.

The water passage B includes a part positioned in the rear casing and a part positioned in the front casing. As shown in FIG. 8, in addition to the inner tube 60, the part in the rear casing further includes a passage 90 communicating the other side of the solid body 401 and rear edge of the solid body 403 for communicating the inner tube 60 and the cavity 46 in which the water inlet switch 75 is mounted. The water passage B further includes an outlet 92 passing from the front edge of the solid body 403 to the front end of the rear casing.

Figure 9:
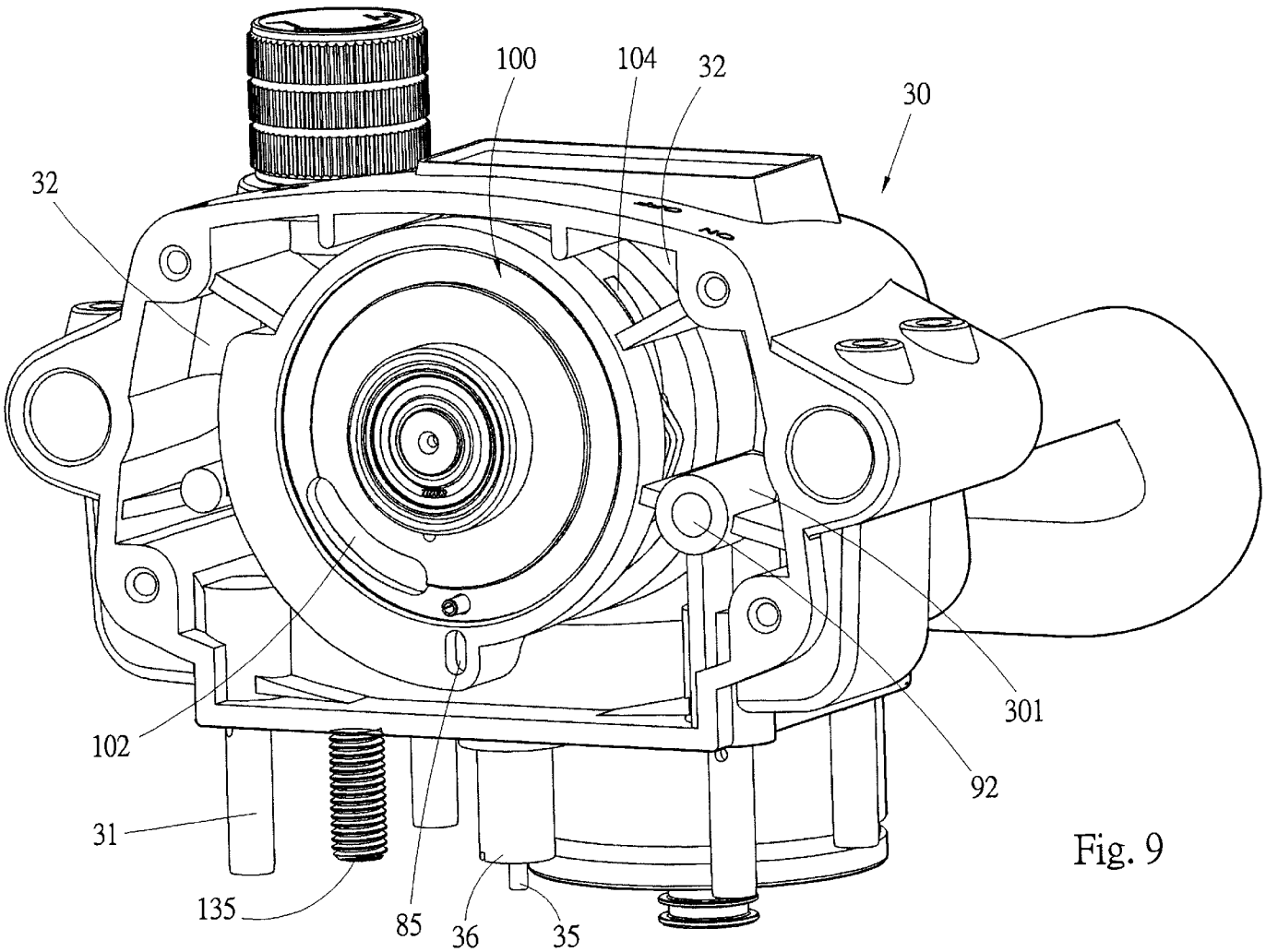
FIG. 9 is a back perspective view of the front casing of FIG. 1.
Figure 10:
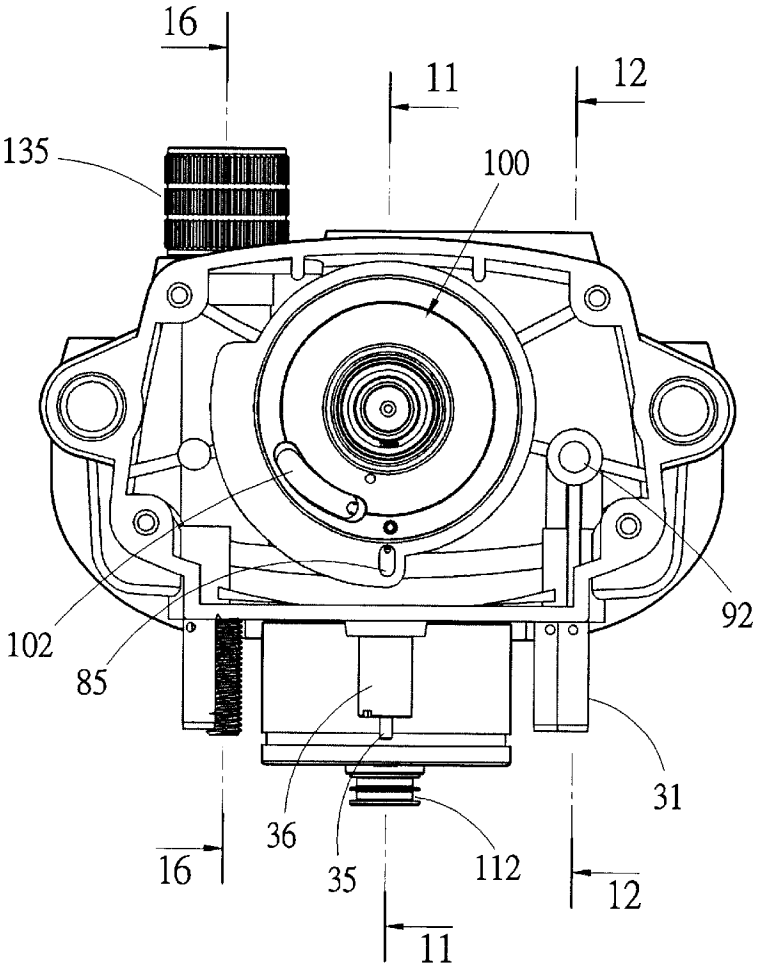
FIG. 10 is an end view according to FIG. 9.
Figure 11:
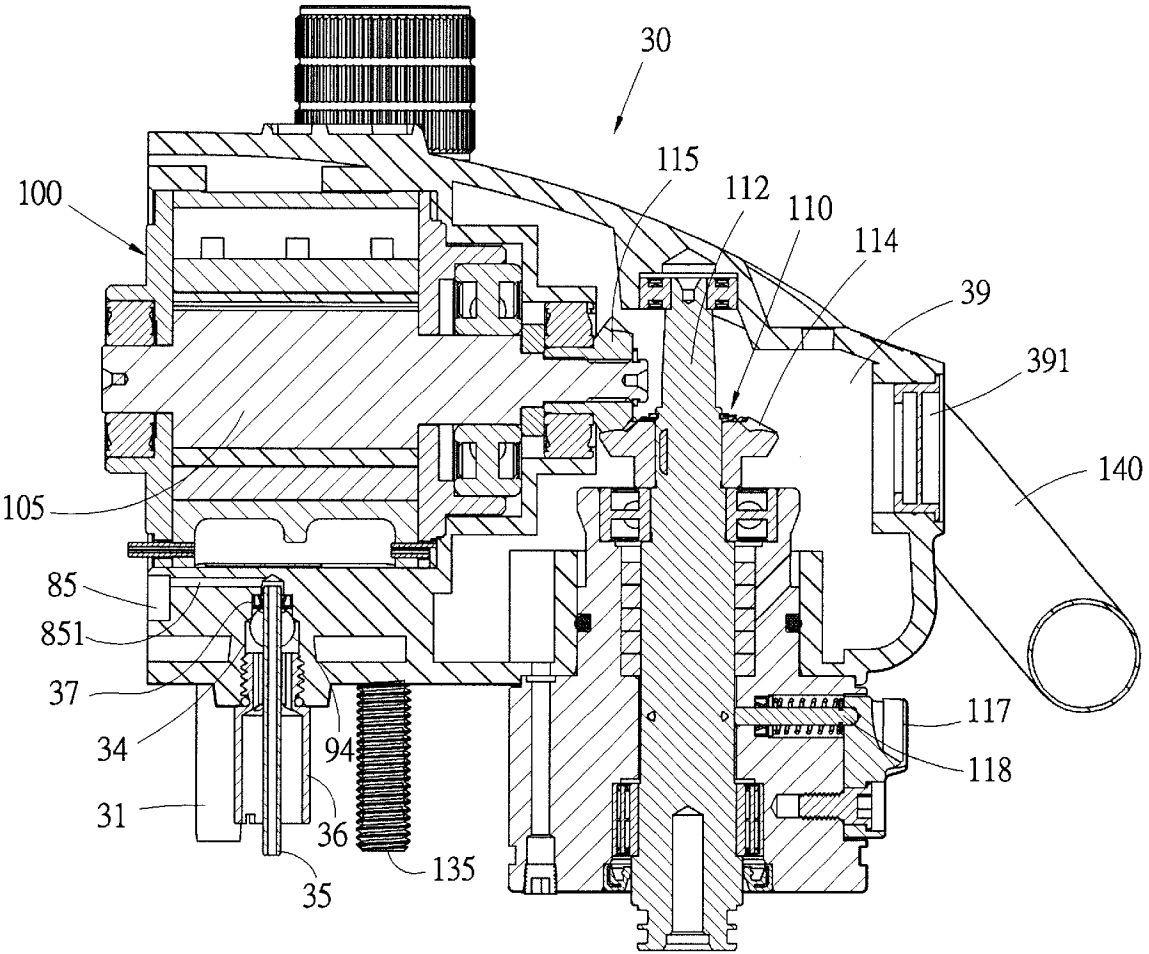
FIG. 11 is a sectional view taken along line 11—11 of FIG. 10.

Referring to FIGS. 9 and 10, the front casing 30 has a hollow interior section forming another part of the air chamber 32. The hollow interiors of the front and rear casings together form the complete air chamber 32. Referring to FIG. 11, a second inner tube 35 and a second outer tube 36 are concentrically disposed in a stepped hole 34 of bottom face of the front casing. A leakproof ring 37 is disposed between the top end of the inner tube 35 and the stepped hole 34 to keep an airtight effect between the inner and outer tubes. The inner tube 35 is also a part of the air passage A, while the outer tube 36 is a part of the water passage B.

The pneumatic cylinder 100 is mounted in the front casing 30 and a rotor 105 is installed in the cylinder as shown in FIG. 11. The cylinder pertains to prior art and will not be further described hereafter. As shown in FIG. 9, an intake 102 is formed at rear end of the cylinder 100 through which the air goes into the cylinder. Multiple exhaustion ports 104 which are arched tunnels are formed on the circumference of the cylinder, whereby the interior of the cylinder communicates with the air chamber 32.

The part of the air passage A in the front casing 30 further includes an entrance 85 formed on back face of the front casing 30 and via a flow way 851 communicating with top end of the second inner tube 35 as shown in FIG. 11.

Figure 12:
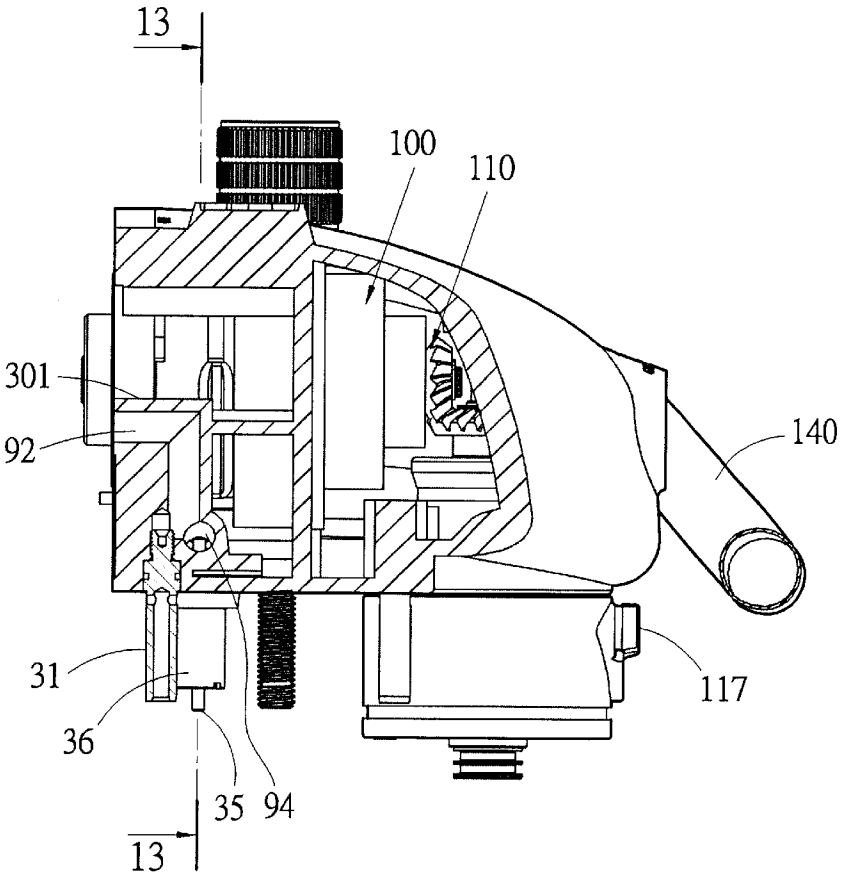
FIG. 12 is a sectional view taken along line 12—12 of FIG. 10.
Figure 13:
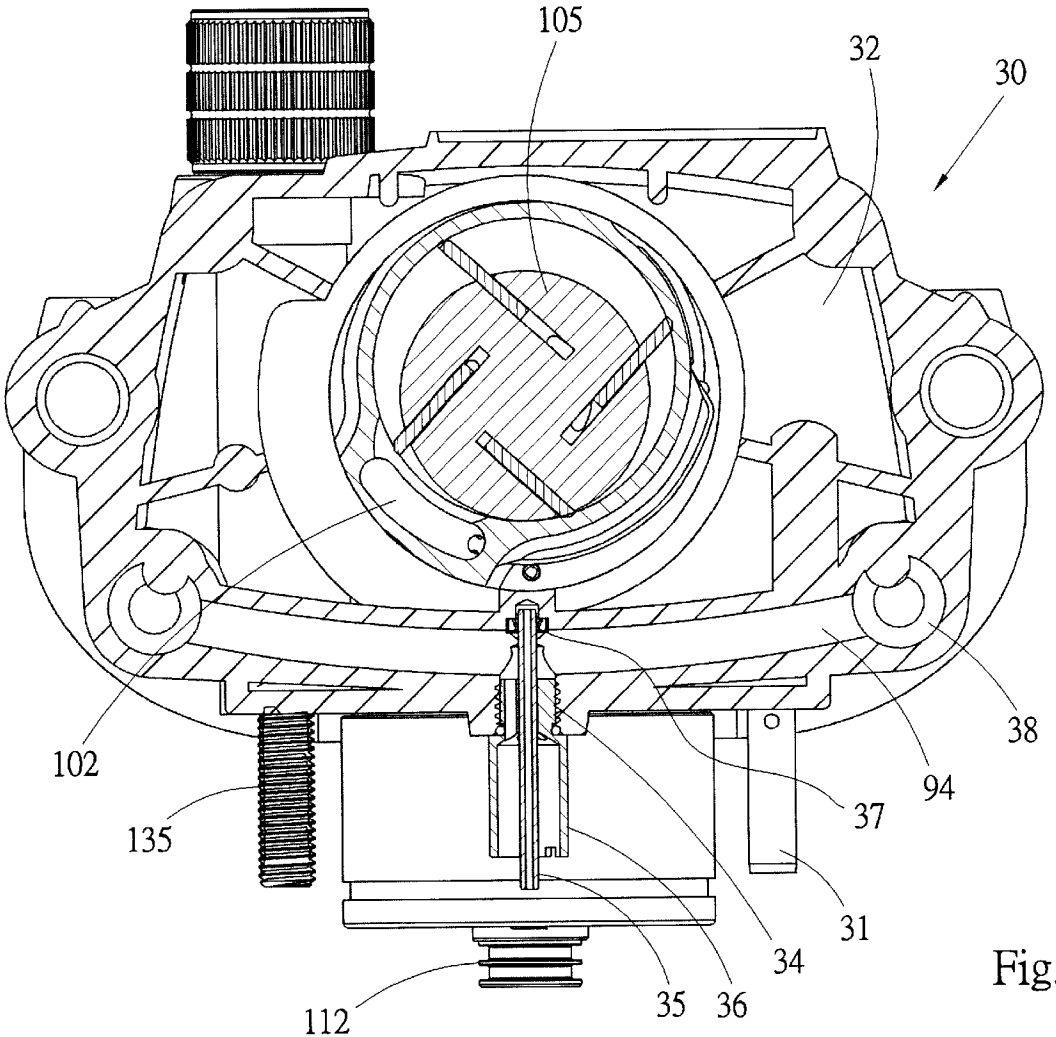
FIG. 13 is a sectional view taken along line 13—13 of FIG. 12.

The part of the water passage B in the front casing further includes a flow conducting way 92 formed on the solid body 301 of the front casing and passing into the front casing. As shown in FIG. 12, the flow conducting way 92 is reverse L-shaped and downward passes near the bottom face of the front casing. Referring to FIG. 13, a bypass 94 is transversely formed on the front casing. Two ends of the bypass 94 are adjacent to two sides of the front casing. The inner end of the flow conducting way 92 communicates with the bypass 94 as shown in FIG. 12. The middle portion of the flow conducting way communicates with the stepped hole 34 of the front casing to communicate with the second outer tube 36.

Figure 14:
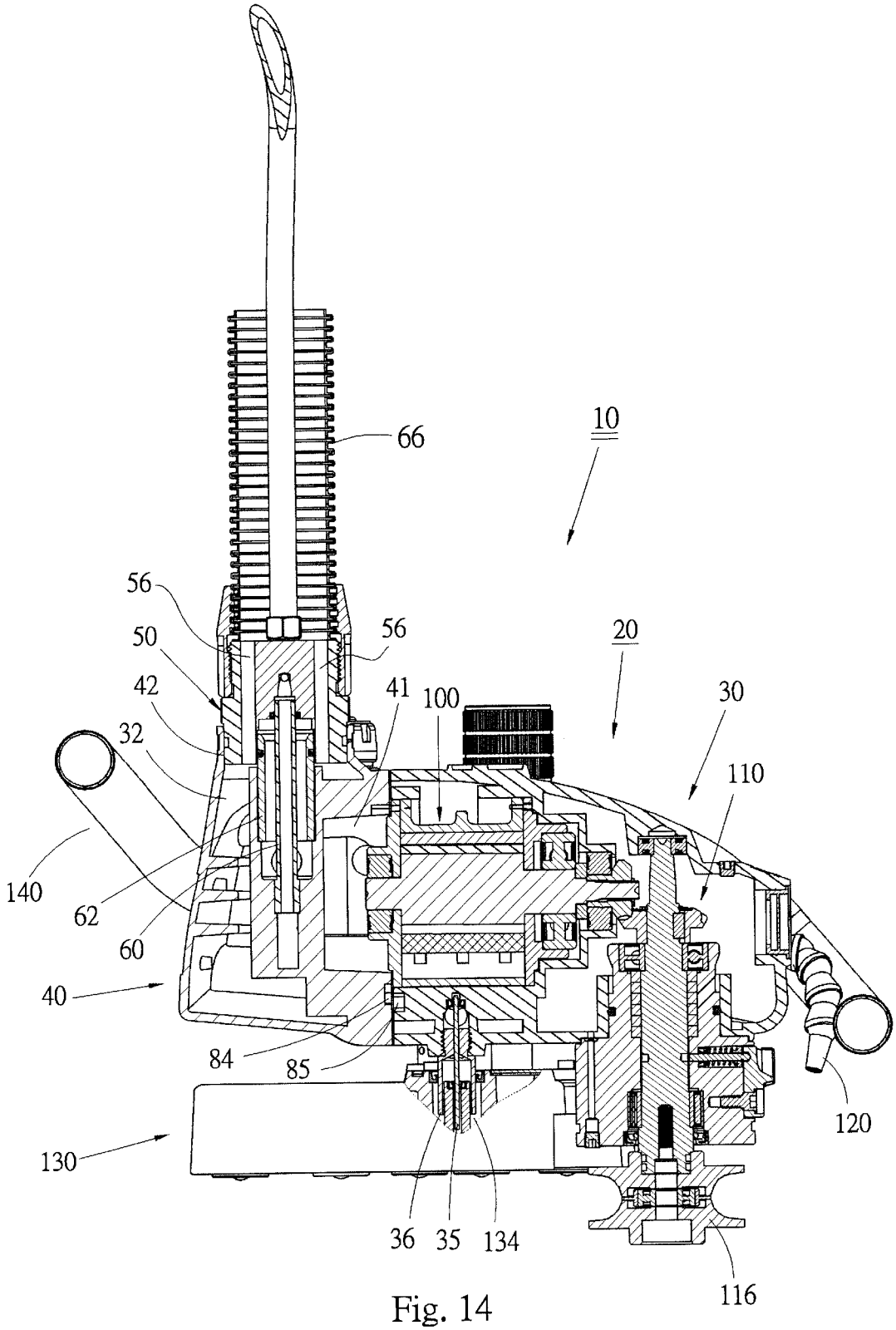
FIG. 14 is a longitudinal sectional view of the present invention.

After the front casing 30 is assembled with the rear casing 40, the rear end of the cylinder is aligned with and tightly associated with the cavity 41 of the rear casing 40 as shown in FIG. 14, whereby the intake 102 communicates with the cavity. The bottom end of the arched passage 84 of the air passage A of the rear casing (that is, the small hole 331 of the washer) is aligned with the entrance 85. The outlet 92 of the water passage B of the rear casing is tightly associated with the flow conducting way 92.

As shown in FIG. 11, the transmission mechanism 110 is pivotally disposed in the oil room 39 of front end of the front casing 30. The transmission mechanism 110 includes a rotary shaft 112 pivotally disposed in the front casing 30. A bevel gear 114 of the rotary shaft is engaged with another bevel gear 115 connected with the rotor 105, whereby the rotary shaft is drivable by the rotor. A grinding wheel 116 is mounted at a protruding end of the rotary shaft 112. A lubricant is filled in the oil room 39. The front end of the front casing has a transparent window 391 for a user to observe the oil amount.

A rotary switch 117 is pivotally disposed at the front end of the front casing. When turning the rotary switch, a rod member 118 is driven to extend or retract. When the rod member is extended inward, it is engaged in one of several dents (not shown) formed on the circumference of the rotary shaft 112, whereby the rotary shaft cannot rotate for replacing the grinding wheel.

Referring to FIG. 1, two water outlet tubes 120 are respectively disposed in the holes 38 of two sides of the front casing 30 to communicate with two ends of the bypass 94.

Figure 15:
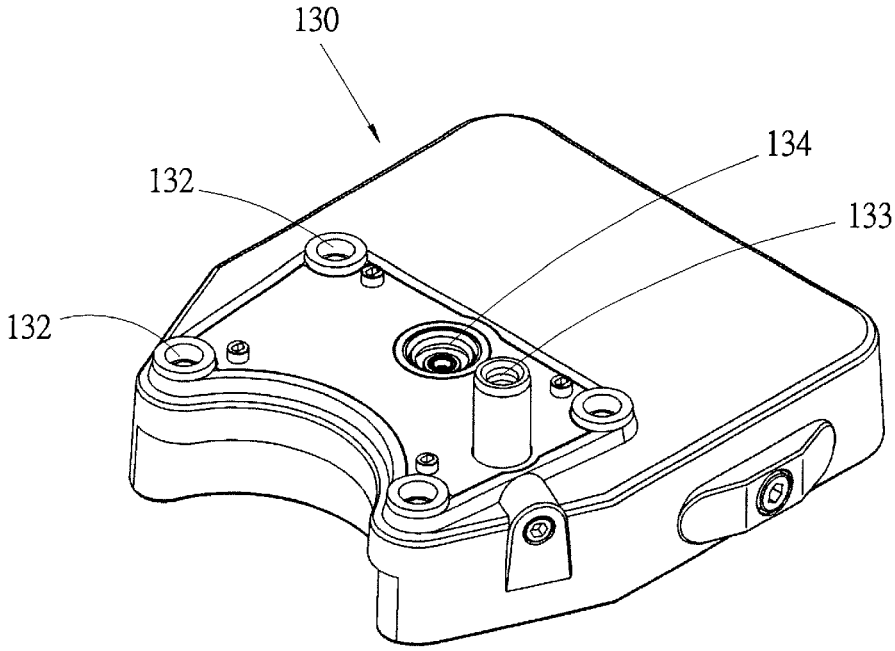
FIG. 15 is a perspective view of the base seat of FIG. 1.
Figure 16:
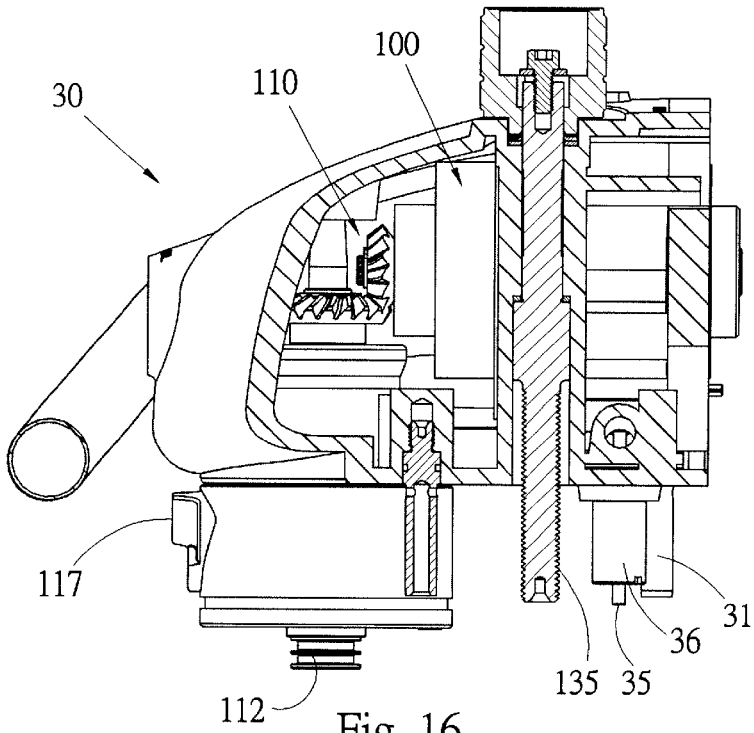
FIG. 16 is a sectional view taken along line 16—16 of FIG. 10.

A base seat 130, referring to FIG. 15, a top face of which is formed with four connecting holes 132. Four projecting posts 31 disposed on bottom face of the front casing 30 are fitted in the four connecting holes 132, whereby the base seat can up and down slide on the main body 20. Referring to FIG. 16, a threaded rod 135 is pivotally disposed in the front casing. The bottom end of the threaded rod 135 is screwed in a thread hole 133 of the base seat for adjusting the height between the main body and the base seat.

The second inner and outer tubes 35, 36 positioned on the bottom face of the front casing are fitted through a hole 134 of the base seat for conducting the fluid into the base seat. The structure and the conduction of the fluid into the base seat will be described in another application of this applicant.

A holding body 140 is fixedly connected with the projecting sections 22 of two sides of the main body 20 around the main body for an operator to move the grinder.

Figure 17:
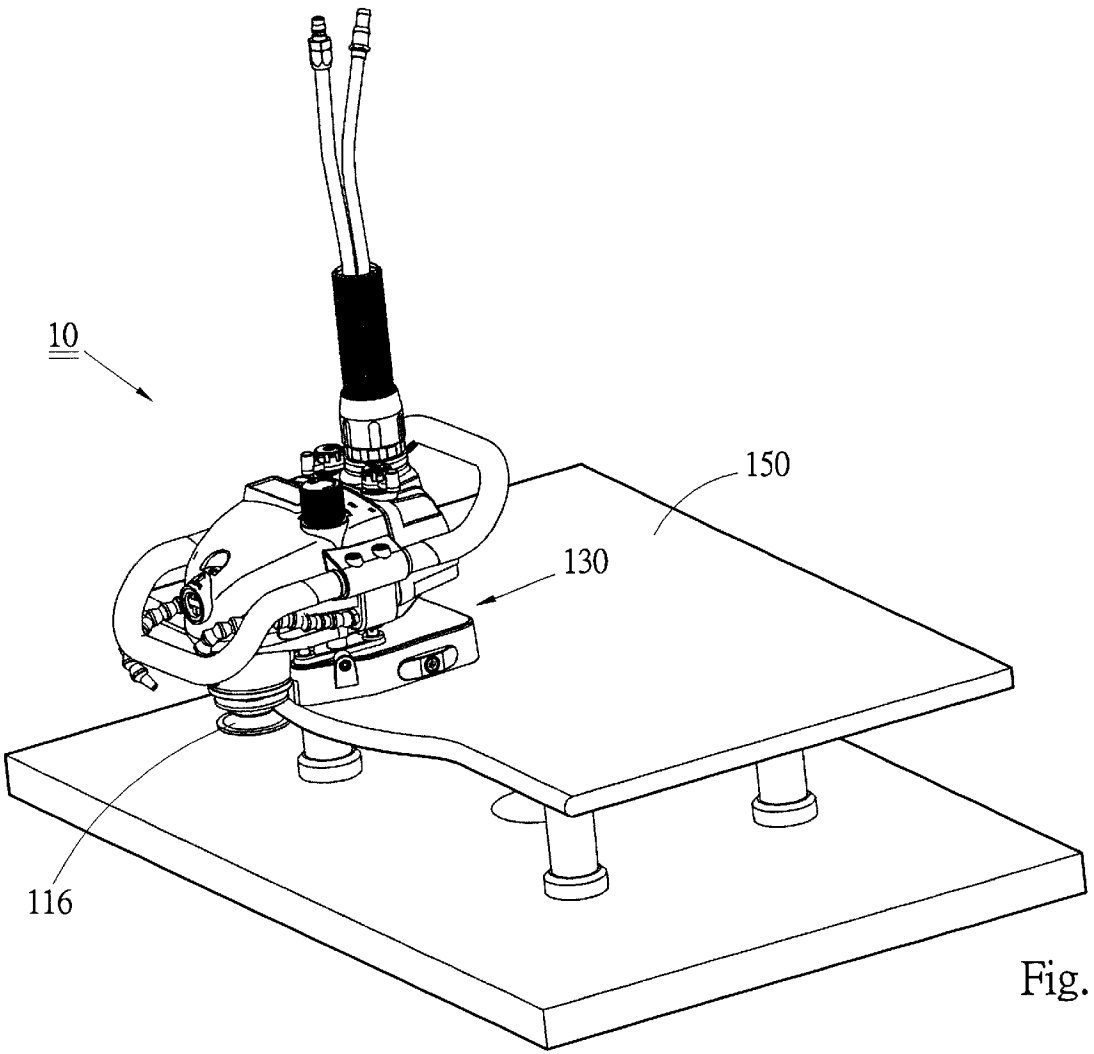
FIG. 17 shows the use of the preferred embodiment of the present invention.

FIG. 17 shows the use of the present invention, in which the grinder is placed on a stone material 150 and the grinding wheel 116 is used to grind the edge of the stone material.

In operation, a user turns the air inlet switch 70 into a state as shown in FIG. 7, when the tunnel 74 of the valve 73 communicates with the flow way 80, main hole 82 and subsidiary hole 83 of the air passage A, as shown in FIG. 5, the high pressure air can flow from the air inlet tube 57 into the air inlet 54. The high pressure air flows through the first outer tube 62 into the flow way 80 and further flows from the tunnel 74 of the valve 73 to the main hole 82 and subsidiary hole 83 to form two airflows toward the front casing. When the valve 73 of the air switch is turned by different angles, the tunnel 74 is controlled to communicate with the flow way 80 or not to communicate with the flow way 80. Also, the flow of the air can be controlled.

The high pressure air flowing out from the main hole 82 flows into the cavity 41 of the rear casing 40 and then flows from the intake 102 of rear end of the cylinder 100 into the cylinder to drive the rotor 105 to rotate. The high pressure air then is exhausted from the exhaustion port 104 to flow into the air chamber 32. The rotor 105 rotates to drive the transmission mechanism 110, whereby the rotary shaft 112 drives the grinding wheel 116 to rotate for creating grinding effect.

After the high pressure air is exhausted from the exhaustion port 104 into the air chamber 32, the high pressure air is exhausted from the air outlets 56 of the connector 50 connected with the rear casing 40 as shown in FIG. 14. Then the air is upward exhausted along the soft tube 66. Accordingly, an airflow circuit is formed.

In addition, the high pressure air flowing out from the subsidiary hole 83 flows into the arched tunnel 84 as shown in FIG. 2. Then the high pressure air flows from the small hole 331 into the entrance 85 of the front casing 30. Then, as shown in FIG. 11, the air is conducted into the second inner tube 35 to further flow to the base seat 130 to form another airflow circuit With respect to the water flow circuit of the present invention, referring to FIG. 8, the water inlet switch 75 is turned to make the tunnel 78 of the valve 77 communicate with the passage 90 and outlet 92 of the water way B to activate the water flow. Similarly, by means of turning the valve of the water inlet switch to different angular positions, the water way is controlled to open or close and the water flow amount can be adjusted. After the water way is opened, the water is conducted from the water inlet tube 58 to flow through the water inlet 55, oblique hole 501 and the inner tube 60 into the passage 90. Then the water flows through the tunnel 78 of the valve to reach the outlet 92. Then, the water flows into the flow conducting way 92 disposed on the front casing 30 as shown in FIGS. 9 and 12. Then the water flows through the flow conducting way 92 to the bypass 94 as shown in FIG. 13. In the bypass 94, the water flow is divided into three directions. One goes into the second outer tube 36 to flow downward into the base seat 130. The other two respectively flow from two ends of the bypass 94 into the holes 38 of two sides of the front casing 30 and flow out from the water outlet tubes 120 to wet the powdered dust produced in grinding operation.

When turning the threaded rod 135, the distance between the main body 20 and the base seat 130 can be adjusted to adjust the height of the grinding wheel 116 in accordance with different thickness of stone material.

The connector 50 is rotatable and the water way and airway are concentric with the water inlet and air inlet. Therefore, in operation, when a user moves the grinder, the connector is turned on the main body 20, while the water way and airway still keep independent and free. In addition, the air inlet tube 57 and the water inlet tube 58 will not tangle with each other.

Furthermore, the air outlet, water inlet and air inlet are disposed in the same position to facilitate connection of pipeline and simplify the appearance. In addition, the internal flow way is uniquely designed to greatly minify the volume of the grinder in comparison with the conventional device.

In addition, the waste gas of the present invention is upward exhausted via the air outlet and soft tube without directly blowing to human body or the ground work piece. Therefore, the flying powdered dust in the working site is minimized and the industrial safety and sanitation are enhanced.

The above embodiment is only used to illustrate the present invention, not intended to limit the scope thereof. Many modifications of the above embodiment can be made without departing from the spirit of the present invention.

What is claimed is:

1. Flow way structure of pneumatic tool, comprising:

a main body having an internal air chamber;

a connector rotatably disposed on the main body;

an air inlet, a water inlet and at least one air outlet concentrically arranged on the connector, inner end of each the air outlet communicating with the air chamber;

a pneumatic cylinder having an internal rotor, an air intake being disposed on the cylinder through which the air flows into the cylinder, several air exhaustion ports being disposed on a circumference of the cylinder to communicate with the interior of the cylinder and the air chamber;

an air inlet switch having a valve and a switch connected with each other, the valve being disposed in the main body, the switch being positioned on outer side of the main body for a user to turn;

an air way disposed in the main body and having a rear section and a front section, the rear section being connected with the air inlet and the valve of the air inlet switch, the front section being connected with the valve and the air intake of the cylinder;

a water inlet switch having a valve and a switch connected with each other, the valve being disposed in the main body, the switch being positioned on outer side of the main body for a user to turn;

at least one water outlet tube connected with the main body;

a water way including a front section and a rear section, the rear section being connected with the water inlet and the valve of the water inlet switch, the front section being connected with the valve and the water outlet tube;

the end of the air way connecting with the air inlet and the end of the water way connecting with the water inlet being concentrically disposed, whereby when the connector rotates on the main body, the air inlet and the water inlet respectively still keep communicating with the air way and the water way; and a transmission mechanism disposed in the main body and driven by the rotor of the cylinder.

2. Pneumatic tool as claimed in claim 1, wherein the main body is formed with a through hole communicating with the air chamber, the connector being rotatably disposed in the through hole, the air outlet passing through the inner end of the connector to communicate with the air chamber.

3. Pneumatic tool as claimed in claim 2, wherein the through hole is formed on top face of the main body.

4. Pneumatic tool as claimed in claim 2, wherein a predetermined number of balls are embedded in the circumference of the through hole at intervals, an annular groove being formed on the circumference of inner end of the connector, whereby the balls are engaged in the annular groove.

5. Pneumatic tool as claimed in claim 1, further comprising a first inner tube and a first outer tube which are concentrically disposed in the main body, the airway and water way being divided into the inner and outer tubes to respectively communicate with the air inlet and water inlet.

6. Pneumatic tool as claimed in claim 1, further comprising a tube, one end of the tube body being fitted with outer end of the connector to enclose the air inlet tube, water inlet tube and the air outlet.

7. Pneumatic tool as claimed in claim 1, further comprising a base seat connected with bottom face of the main body, the front section of the air way including two branches, one of which communicates with the cylinder while the other of which communicates with the base seat.

8. Pneumatic tool as claimed in claim 7, wherein the front section of the water way includes two branches, one of which communicating with the water outlet tube, while the other of which communicating with the base seat.

9. Pneumatic tool as claimed in claim 8, wherein the branches of the air way and water way communicating with the base seat are conducted from the same position of the bottom face of the main body into the base seat.

10. Pneumatic tool as claimed in claim 9, further comprising a second inner tube and a second outer tube which are concentrically disposed on the bottom face of the main body; the branches of the front sections of the air way and water way respectively via the inner and outer tubes communicating with the base seat.

11. Pneumatic tool as claimed in claim 1, further comprising a base seat connected with bottom face of the main body, the front section of the water way including two branches, one of which communicates with the water outlet tube while the other of which communicates with the base seat.

12. Pneumatic tool as claimed in claim 1, wherein there are two water outlet tubes respectively disposed on two sides of the main body, the front section of the water way having a transverse bypass, two ends of the bypass respectively communicating with the two water outlet tubes.

13. Pneumatic tool as claimed in claim 1, wherein a predetermined number of projecting posts are disposed on the bottom face of the main body; further comprising a base seat, a top face of the base seat being formed with connecting holes and a thread hole, the number of the connecting holes being equal to that of the projecting posts, the projecting posts of the main body being inserted in the connecting holes of the base seat; a threaded rod being pivotally disposed in the main body and manually rotatable, a bottom end of the threaded rod protruding from the bottom face of the main body and screwed in the thread hole.

14. Pneumatic tool as claimed in claim 1, wherein the main body is composed of a front casing and a rear casing, the air chamber including a part in the front casing and another part in the rear casing; the connector, air inlet switch, water inlet switch and the rear sections of the air way and water way being disposed in the rear casing, while the cylinder, transmission mechanism and the front sections of the air way and water way being disposed in the front casing.

15. Pneumatic tool as claimed in claim 1, wherein a holding body is disposed around the main body.

16. Pneumatic tool as claimed in claim 1, wherein the main body is formed with two cavities, the valves of the air inlet switch and water inlet switch being respectively airtight movably disposed in the cavities, the rear section of the air way communicating with the cavity in which the air inlet switch is mounted, the rear section of the water way communicating with the cavity in which the water inlet switch is mounted, each of the valves of the air inlet switch and water inlet switch being formed with a tunnel, whereby by means of turning the valves, the states in which the tunnels of the valves respectively communicate with the air way and water way can be controlled.

* * * * *